US009517917B2

(12) United States Patent
Tokura

(10) Patent No.: US 9,517,917 B2
(45) Date of Patent: Dec. 13, 2016

(54) ELEVATOR SYSTEM OPTIMIZING THE REGISTRATION OF A DESTINATION CALL AND THE CAR ASSIGNMENT TO A REGISTERED CALL

(75) Inventor: Sakurako Tokura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 494 days.

(21) Appl. No.: 14/112,449

(22) PCT Filed: May 10, 2011

(86) PCT No.: PCT/JP2011/060708
§ 371 (c)(1),
(2), (4) Date: Oct. 17, 2013

(87) PCT Pub. No.: WO2012/153386
PCT Pub. Date: Nov. 15, 2012

(65) Prior Publication Data
US 2014/0041968 A1 Feb. 13, 2014

(51) Int. Cl.
*B66B 1/16* (2006.01)
*B66B 1/24* (2006.01)
*B66B 1/46* (2006.01)

(52) U.S. Cl.
CPC ..... *B66B 1/16* (2013.01); *B66B 1/2433* (2013.01); *B66B 1/2458* (2013.01); *B66B 1/46* (2013.01);
(Continued)

(58) Field of Classification Search
CPC ..... B66B 1/16; B66B 1/2433; B66B 1/2458; B66B 1/46; B66B 2201/103; B66B 2201/104; B66B 2201/302; B66B 2201/306; B66B 2201/403; B66B 2201/4615; B66B 2201/4646
(Continued)

(56) References Cited

U.S. PATENT DOCUMENTS 3,750,850 A * 8/1973 Winkler ..... B66B 1/52 187/295
4,084,661 A * 4/1978 Quan ..... B66B 1/20 187/385
(Continued)

FOREIGN PATENT DOCUMENTS

JP 63 247280 10/1988
JP 05 162927 6/1993
(Continued)

OTHER PUBLICATIONS

European Norm EN 81-70: 2003E, Annex F(normative),(Total 2 pages),(2003).
(Continued)

*Primary Examiner* — Anthony Salata
(74) *Attorney, Agent, or Firm* — Oblon, McClelland, Maier & Neustadt, L.L.P.

(57) ABSTRACT

An elevator system includes: a destination call registration device which accepts an operation of registering a destination call by specifying a destination floor; an exit floor selection part provided in the destination call registration device and by use of which a user selects an exit floor provided with an exit of a building as a destination floor of the destination call; an exit floor determination part which determines, on the basis of predetermined conditions, which floor is the exit floor from candidates for an exit floor which are set beforehand as floors capable of being selected as the exit floor among plural floors of the building; and a destination call registration part which registers the destination call in which the specific floor determined as the exit floor by the exit floor determination part is a destination floor in the case the exit floor selection part is operated by a user.

15 Claims, 6 Drawing Sheets

(52) U.S. Cl.
CPC .... *B66B 2201/103* (2013.01); *B66B 2201/104* (2013.01); *B66B 2201/302* (2013.01); *B66B 2201/306* (2013.01); *B66B 2201/403* (2013.01); *B66B 2201/4615* (2013.01); *B66B 2201/4646* (2013.01)

(58) Field of Classification Search
USPC ..... 187/247, 277, 380–389, 391, 393, 395,187/396
See application file for complete search history.

(56) References Cited

U.S. PATENT DOCUMENTS

| | | | | |
|---|---|---|---|---|
| 5,969,304 | A | 10/1999 | Barker et al. | |
| 6,202,799 | B1 * | 3/2001 | Drop | B66B 1/468 187/384 |
| 7,108,106 | B2 * | 9/2006 | Kostka | B66B 1/2416 187/391 |
| 7,650,966 | B2 * | 1/2010 | Sansevero | B66B 1/2466 187/249 |
| 7,694,781 | B2 * | 4/2010 | Sorsa | B66B 1/2458 187/382 |
| 7,766,129 | B2 * | 8/2010 | Makela | B66B 1/20 187/382 |
| 8,151,942 | B2 * | 4/2012 | Rusanen | B66B 1/468 187/247 |
| 8,210,321 | B2 * | 7/2012 | Finschi | B66B 1/14 187/388 |
| 8,230,979 | B2 * | 7/2012 | Finschi | B66B 1/14 187/387 |
| 2005/0029054 | A1 | 2/2005 | Matela | |
| 2009/0294221 | A1 | 12/2009 | Bahjat et al. | |
| 2014/0131142 | A1 * | 5/2014 | Parkkinen | B66B 3/006 187/382 |

FOREIGN PATENT DOCUMENTS

| | | |
|---|---|---|
| JP | 2000 159450 | 6/2000 |
| JP | 2002 087713 | 3/2002 |
| JP | 2005 519008 | 6/2005 |
| JP | 2008 505037 | 2/2008 |

OTHER PUBLICATIONS

International Search Report Issued Aug. 30, 2011 in PCT/JP11/60708 Filed May 10, 2011.
International Preliminary Report on Patentability and Written Opinion issued Dec. 5, 2013 in PCT/JP2011/060708 (submitting English translation only).

* cited by examiner

10:DESTINATION CALL REGISTRATION DEVICE
11:DESTINATION CALL INPUT PART
17:EXIT FLOOR DATA

ELEVATOR SYSTEM OPTIMIZING THE REGISTRATION OF A DESTINATION CALL AND THE CAR ASSIGNMENT TO A REGISTERED CALL

TECHNICAL FIELD

The present invention relates to an elevator system.

BACKGROUND ART

In conventional elevator systems, there are known those in which in addition to a ten-key pad for specifying a destination floor of an elevator, a floor-using button for identifying principal floors of a building in which the elevator is installed is indicated in a touch screen type destination call registration device operated by an elevator user (refer to Patent Literature 1, for example). And this Patent Literature 1 describes that a floor having the functions of a public transportation facilities, parking areas and the like, i.e., a floor provided with an exit of the building in question is set as a floor capable of being identified through the use of this floor-using button.

European Norm EN 81-70: 2003 Appendix F.1 (Non-patent Literature 1) describes that an exit button for registering a destination floor to an exit floor is provided in a key pad for registering destination floors of an elevator.

In double-deck elevators which have two cars vertically adjacent to each other, there have hitherto been known those in which a double operation is carried out which is such that users are transported using both upper and lower cars during congested hours. This double operation is an operation mode in which users are allotted to upper and lower cars, the upper car is caused to stop only at either even-numbered floors or odd-numbered floors and the lower car is caused to stop only at the other of the even-numbered floors or odd-numbered floors, whereby the users are caused to board and disembark from the upper and lower cars simultaneously (refer to Patent Literature 2, for example).

In multi-car elevators in which a plurality of cars are disposed in one shaft, there have hitherto been known those in which a semi-zone operation mode is provided, the semi-zone operation mode being such that each car is operated in such a manner as to serve only a specific zone, which is set for each car, and a specific standard floor (refer to Patent Literature 3, for example).

CITATION LIST

Patent Literature

Patent Literature 1: National Publication of International Patent Application No. 2008-505037

Patent Literature 2: Japanese Patent Laid-Open No: 05-162927

Patent Literature 3: Japanese Patent Laid-Open No. 2002-087713

Non-Patent Literature

Non-patent Literature 1: European Norm EN 81-70: 2003 Appendix F.1

SUMMARY OF INVENTION

Technical Problem

As described above, according to the destination call registration devices as described in Patent Literature 1 and Non-patent Literature 1, an elevator user who wants to leave a building can perform the registration of a destination call in which the exit floor provided with an exit is a destination floor even when the user does not know on which floor the exit of the building exists.

However, in these conventional elevator systems provided with a destination call registration device, the exit floor capable of being registered as a destination floor by the operation of an exit button is fixed. For this reason, the case where a call in which the exit floor is a destination floor was registered by the operation of an exit button poses the problem that depending on the congested condition of the elevator, hours and the like, it is impossible to make the registration of a destination call and the car assignment to a registered call optimum, causing a decrease in operational efficiency.

In the case where the destination call registration devices as described in Patent Literature 1 and Non-patent Literature 1 are applied to the conventional double-deck elevator described in Patent Literature 2, there is a possibility that in some operation modes (in particular, in the case of a double operation), the upper and lower cars cannot stop at the same exit floor. However, in the destination call registration devices described in Patent Literature 1 and Non-patent Literature 1, this point is not taken into consideration. Therefore, also this case poses the problem that it is impossible to make the registration of a destination call and the car assignment to a registered call optimum, causing a decrease in operational efficiency.

As with the case of the conventional double-deck elevator described in Patent Literature 2 described above, particularly in the semi-zone operation mode, also the case where the destination call registration devices as described in Patent Literature 1 and Non-patent Literature 1 are applied to the conventional multi-car elevator described in Patent Literature 3 poses the problem that it is impossible to make the registration of a destination call and the car assignment to a registered call optimum, causing a decrease in operational efficiency.

The present invention has been made to solve the problem described above, and the present invention provides an elevator system which can make the registration of a destination call and the car assignment to a registered call optimum, enabling operational efficiency to be made good in an elevator provided with a destination call registration device having an exit floor button for registering a destination call to an exit floor.

Means for Solving the Problems

An elevator system according to one or more embodiments of the present invention includes a destination call registration device which accepts an operation of registering a destination call by specifying a destination floor of an elevator and an exit floor selection part which is provided in the destination call registration device and by use of which a user selects an exit floor provided with an exit of a building in which the elevator is installed as a destination floor of the destination call. In the one or more embodiments, the elevator system includes an exit floor determination part which determines, on the basis of predetermined conditions, a specific floor as the exit floor from candidates for an exit floor which are set beforehand as floors capable of being selected as the exit floor among a plurality of floors of the building. A destination call registration part is included which registers the destination call in which the specific floor determined as the exit floor by the exit floor determination part is a destination floor, in the case where the exit floor selection part is operated by a user. In this way, the registration of a destination call and the car assignment to a registered call can be optimized.

Advantageous Effect of Invention

The elevator system of the present invention produces the effect that it is possible to make the registration of a destination call and the car assignment to a registered call optimum, enabling operational efficiency to be made good in an elevator provided with a destination call registration device having an exit floor button for registering a destination call to an exit floor.

DESCRIPTION OF EMBODIMENTS

The present invention will be described with reference to the appended drawings. In each of the drawings, identical numerals refer to identical or corresponding parts and repeated descriptions of these parts are appropriately simplified or omitted.

Embodiment 1

Figure 1:
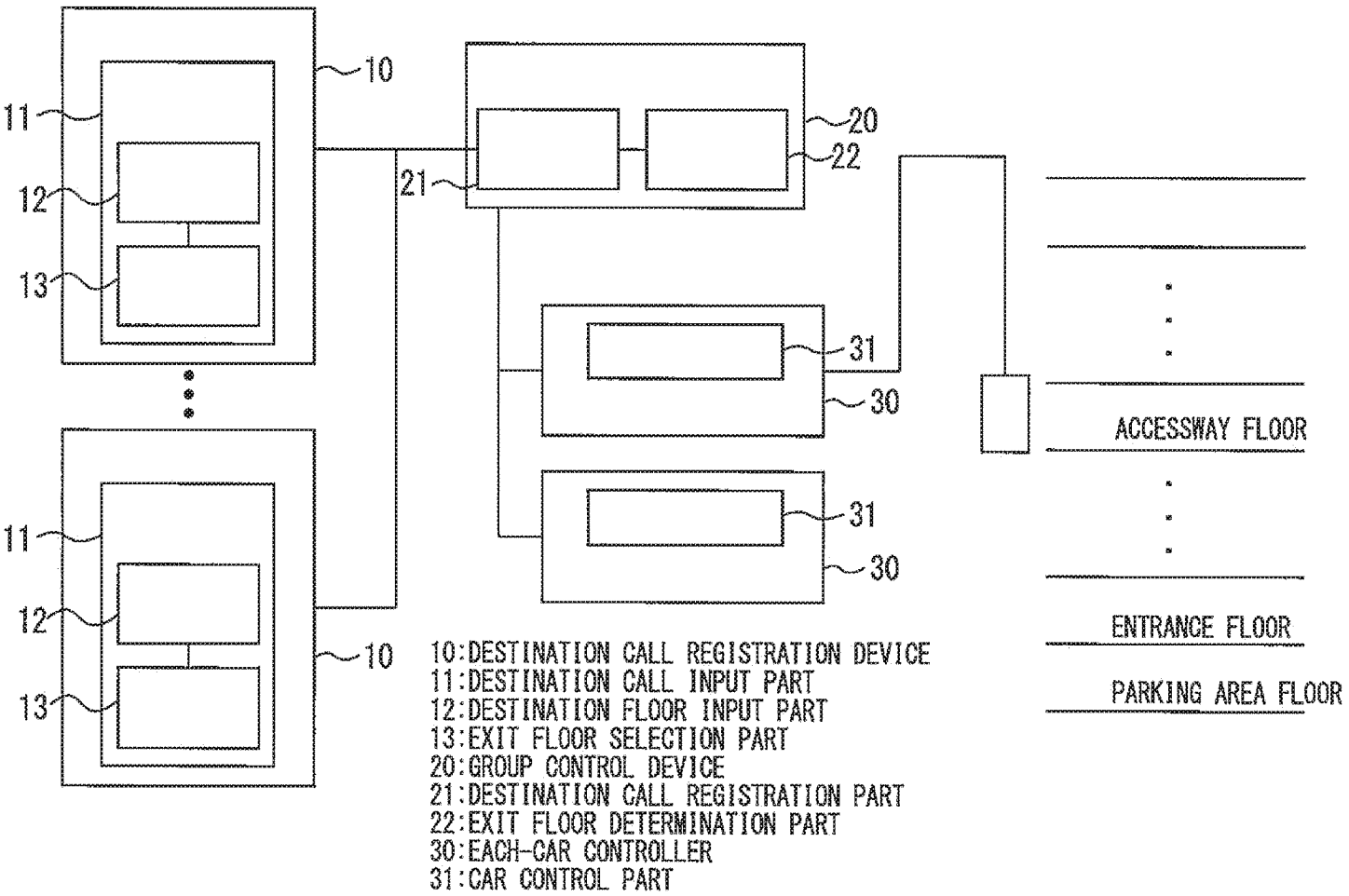
FIG. 1 is a block diagram showing the general configuration of an elevator system relating to Embodiment 1 of the present invention.
Figure 2:
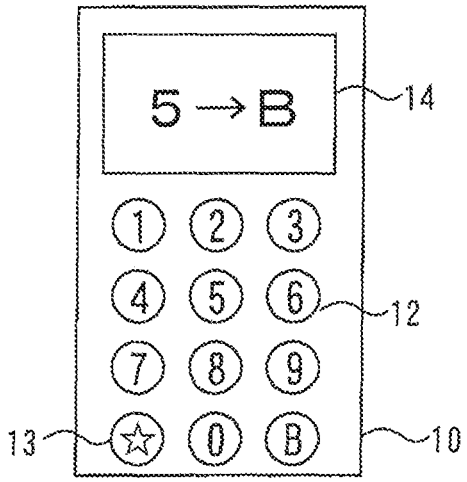
FIG. 2 is a front view of a destination call registration device of the elevator system relating to Embodiment 1 of the present invention.
Figure 3:
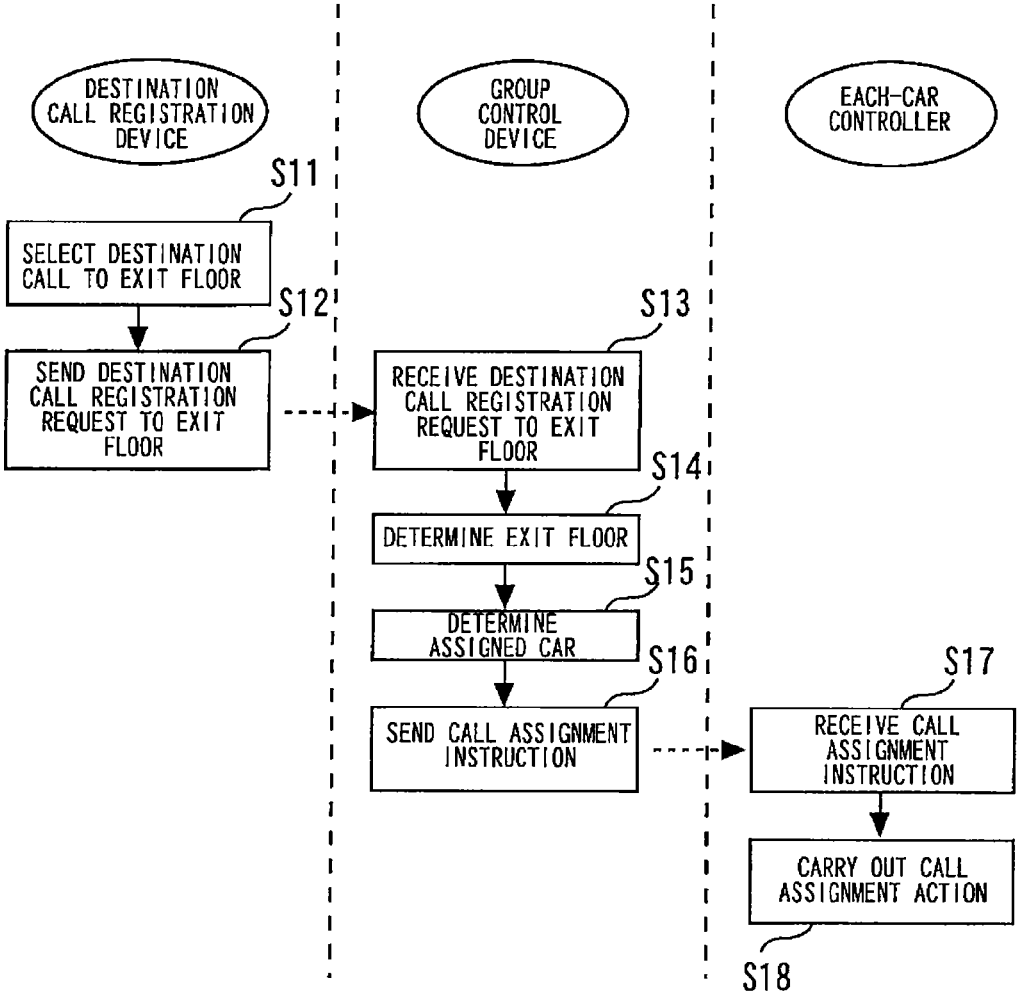
FIG. 3 is a flowchart showing registration actions of the elevator system for a destination call to an exit floor, the elevator system relating to Embodiment 1 of the present invention.

FIGS. 1 to 3 relate to Embodiment 1 of the present invention. FIG. 1 is a block diagram showing the general configuration of an elevator system, FIG. 2 is a front view of a destination call registration device, and FIG. 3 is a flowchart showing registration actions of the elevator system for a destination call to an exit floor.

In FIG. 1, reference numeral 10 denotes a destination call registration device installed, for example, in a hall of each floor of an elevator. This destination call registration device 10 is intended for accepting an operation of registering a destination call by specifying a destination floor of an elevator. The destination call registration device 10 is provided with a destination call input part 11 by use of which an elevator user registers a call to a desired destination floor. This destination call input part 11 is provided with a destination floor input part 12 by use of which a user inputs a desired destination floor by specifying the destination floor by a floor number and an exit floor selection part 13 by use of which a user selects an exit floor as a destination floor.

Here, an exit floor refers to a floor on which an exit of a building in which an elevator is installed is provided. Specifically, examples of this exit floor include a parking area floor on which a parking area is provided and a floor on which an accessway to an adjoining building and to a station of public transportation facilities and the like is provided, in addition to an entrance floor on which an entrance to a building is provided.

FIG. 2 shows an example of the destination call registration device 10. The destination floor input part 12 of the destination call input part 11 provided in the destination call registration device 10 is composed of numerical buttons of "0" to "9" and the "B" button expressing a basement floor. The exit floor selection part 13 of the destination call input part 11 is formed from an exit floor button. A star-shaped relief is provided on the surface of this exit floor button so that the exit floor button can be clearly discriminated from each button constituting the destination floor input part 12. This exit floor button may have a color different from the color of buttons constituting the destination floor input part 12 or may protrude somewhat to the front surface side compared to these buttons. The destination call registration device 10 is also provided with an indication part 14 which indicates the elevator number of a car assigned to a destination call registration performed by an operation on the destination call registration device 10.

It is not always necessary that the destination call registration device 10 be installed in a fixed manner in a hail and the like; the destination call registration device 10 may be configured by using a mobile terminal and the like carried by a user. In this case, as a mobile terminal, it is possible to use those which permit radio communication (infrared communication, Internet communication and the like) with a group control device 20, which will be described later. Examples of a mobile terminal capable of being used as this destination call registration device 10 include a cell phone, a PHS (personal handyphone system), a PDA (personal digital assistance), and a notebook PC.

A dedicated application realizing the function of the above-described destination call registration device 10 is installed beforehand in a mobile terminal as described above, which is carried by a user. And by using this dedicated application on a mobile terminal, the user inputs a desired destination floor or selects an exit as a destination floor. Instead of installing a dedicated application on a mobile terminal beforehand, it is also possible to provide a web application realizing the function of the destination call registration device 10 in such a manner as to be accessible from a mobile terminal, whereby the user performs the registration operation of a destination call by making access to this web application from the mobile terminal.

Referring to FIG. 1 again, the destination call registration device 10 provided in this manner is communicably connected to a group control device 20. This group control device 20 is intended for comprehensively controlling operation actions of a plurality of cars of the elevator system. The destination call registration device 10 sends a destination call registration request to the group control device 20 according to the contents of an operation on the destination call input part 11. More specifically, in the case where the destination floor input section 12 was operated, the destination call registration device 10 sends a destination call registration in which the floor specified by this operation is a destination floor, whereas in the case where the exit floor selection part 13 was operated, the destination call registration device 10 sends a destination call registration request in which an exit floor is a destination floor.

The group control device 20 is provided with a destination call registration part 21 and an exit floor determination part 22. The destination call registration part 21 is intended for registering a destination call on the basis of a destination call registration request sent from the destination call registration device 10 and assigning a car corresponding to a registered destination call. In the case where a destination floor of the destination call registration request sent from the destination call registration device 10 was an exit floor, the exit floor determination part 22 determines which floor is the exit floor which is the destination floor of the destination call registration request in question.

More specifically, among a plurality of floors of a building in which an elevator is installed, floors capable of being selected as an exit floor are set beforehand as candidates for an exit floor in the exit floor determination part 22. The exit floor determination part 22 selects and determines an exit floor from these candidates for an exit floor on the basis of predetermined conditions including the condition of the elevator, hours and the like as requirements. And in the case where the destination floor of the destination call registration request sent from the destination call registration device 10 was an exit floor, the destination call registration part 21 registers a destination call in which the exit floor determined by the exit floor determination part 22 is a destination floor.

Each-car controllers 30 are communicably connected to the group control device 20 in numbers corresponding to the number of cars of the elevator system. These each-car controllers 30 are provided for each of a plurality of cars of the elevator system. An each-car controller 30 is intended for controlling the operation actions of each corresponding car under the comprehensive control by the group control device 20.

These each-car controllers 30 are provided with a car control part 31 which controls specific operation actions of a car. And the car control part 31 causes a car assigned to a destination call registration to run to a destination floor in accordance with a destination call registration performed by the destination call registration part 21 of the group control device 20 and car assignment.

In the case where group control is not required in an elevator system, a control device which controls the operation actions of each car may be provided and this control device may be provided with the destination call registration part 21, the exit floor determination part 22, and the car control part 31.

The flowchart of FIG. 3 shows actions of the elevator system in this embodiment configured as described above.

First, in Step S11 the exit floor selection part 13 of the destination call registration device 10 is operated by a user. Then, the flow of actions proceeds to Step S12, where the destination call registration device 10 sends a destination call registration request in which an exit floor is a destination floor to the group control device 20. In Step S13, the group control device 20 receives the destination call registration request in which an exit floor is a destination floor, which was sent from the destination call registration device 10. And the flow of actions proceeds to Step S14, where the exit floor determination part 22 of the group control device 20 determines, on the basis of predetermined conditions, an exit floor which becomes a destination floor of the received destination call registration request.

A description will be given of this determination of an exit floor based on predetermined conditions by the exit floor determination part 22 in Step S14 by taking concrete examples. As described above, the predetermined conditions include the condition of the elevator, hours and the like as requirements.

First, as a first example, a description will be given of the elevator system in which an exit floor is determined on the basis of the condition of the elevator, in particular, the congested condition of the elevator as a condition. In this example, an entrance floor where the entrance of the building is present (a standard floor) is regarded as an exit floor in normal times when the elevator is not crowded, whereas a floor one floor above an entrance floor (a standard floor) is regarded as an exit floor when the elevator is crowded.

By doing like this, in normal times with an entrance floor (a standard floor) as an exit floor, a user who is going to leave the building can be carried to a floor where the entrance exists, whereas when the elevator is crowded, with a floor one floor above an entrance floor (a standard floor) as an exit floor, the entrance floor (a standard floor) is dedicated to boarding, whereby the flow of users is made smooth and it is possible to make the operational efficiency of the elevator good.

In this first example, an entrance floor, which is a standard floor, and a floor one floor above this standard floor, i.e., two floors are set beforehand as candidates for an exit floor. And the exit floor determination part 22 determines an exit floor as a standard floor when the congestion degree of the elevator is smaller than a predetermined threshold value and determines an exit floor as a floor one floor above a standard floor when the congestion degree of the elevator is larger than a predetermined threshold value. The congested condition of the elevator can be judged from images picked up by a monitor camera installed in a hall and a car or by using detection results of weighing equipment provided in a car and the like.

Next, as a second example, a description will be given of the elevator system in which an exit floor is determined on the basis of hours as a condition. In this example, it is assumed that a building in which the elevator is installed has an accessway floor in which an accessway to a station of public transportation facilities, such as a subway, is provided in addition to an entrance floor. And an accessway floor is regarded as an exit floor during hours when public transportation facilities are operated and an entrance floor (a standard floor) is regarded as an exit floor during hours when public transportation facilities are not operated.

That is, in this second example, an entrance floor, which is a standard floor, and an accessway floor in which an accessway to a station of public transportation facilities is present, i.e., two floors are set beforehand as candidates for an exit floor. And the exit floor determination part 22 determines an exit floor as a standard floor in the case where the present time belongs to hours where the transportation facilities are not operated and determines an exit floor as an accessway floor in the case where the present time belongs to hours where the transportation facilities are operated.

And as a third example, a description will be given of the elevator system in which when the elevator is a double-deck elevator, an exit floor is determined on the basis of conditions including operation modes of this double-deck elevator and the departure floor of a destination floor which is going to be registered from now as elements. In this double-deck elevator, when the elevator is crowded, a double-operation is performed; the floors at which the upper car and the lower car stop are completely separated (for example, the upper car is caused to stop only at either odd-numbered floors or even-numbered floors, whereas the lower car is caused to stop only at the other of the odd-numbered floors or even-numbered floors.)

Therefore, during this double operation, the floor at which a car can stop is determined depending on which of the upper car or the lower car is assigned to a destination call registration. Which of the upper car or the lower car is assigned to a destination call registration is determined by the departure floor of this destination call registration. Therefore, during a double operation, according to the departure floor of a destination call which is going to be registered from now, it is ensured that an exit floor for the upper car selected from the floors at which the upper car stops is determined as an exit floor in the case where the departure floor in question is the floor at which the upper car stops, whereas an exit floor for the lower car selected from the floors at which the lower car stops is determined as an exit floor in the case where the departure floor in question is the floor at which the lower car stops.

That is, in this third example, an exit floor for the upper car selected from the floors at which the upper car stops during a double operation and an exit floor for the lower car selected from the floors at which the lower car stops during a double operation, i.e., two floors are set beforehand as candidates for an exit floor. And the exit floor determination part 22 determines an exit floor for the upper car as an exit floor in the case where the departure floor of the destination call which is going to be registered from now during a double operation is the floor at which the upper car stops and determines an exit floor for the lower car as an exit floor in the case where the departure floor in question is the floor at which the lower car stops.

By doing like this, during a double operation, it is possible to determine an exit floor within the range of destination floors assigned to each of the upper car and the lower car, and hence it is possible to carry out an efficient operation of a double-deck elevator without impairing a double operation.

And as a fourth example, a description will be given of the elevator system in which in the case where the elevator is a one-shaft multi-car elevator in which a plurality of cars are disposed within a shaft, an exit floor is determined on the basis of the conditions including, as elements, an operation mode of this one-shaft multi-car elevator and a departure floor of a destination call which is going to be registered from now. In this one-shaft multi-car elevator, a semi-zone operation is performed in which each car serves only a specific zone set for each car and a specific standard floor according to the congested condition of elevators and the like.

Therefore, during this semi-zone operation, a standard floor at which an elevator can stop is determined depending on which of the cars is assigned to a destination call registration. Which of the cars is assigned to a destination call registration is determined by the departure floor of the destination call registration. Therefore, during a semi-zone operation, it is ensured that depending on a departure floor of a destination call which is going to be registered from now, a standard floor of a car in charge of the zone to which this departure floor belongs is determined as an exit floor.

That is, in this fourth example, the standard floor of each car during a semi-zone operation is set beforehand as a candidate for an exit floor. And during a semi-zone operation, the exit floor determination part 22 sets, as an exit floor, a standard floor of a car in charge of the zone to which the departure floor of a destination call which is going to be registered from now belongs.

By doing like this, during a semi-zone operation, it is possible to determine an exit floor within the range of destination floors assigned to each car, and hence it is possible to carry out an efficient operation of a one-shaft multi-deck elevator without impairing a semi-zone operation.

When in Step S14 the exit floor determination part 22 has determined an exit floor in the manner described above, the flow of actions proceeds to Step S15, where the destination call registration part 21 registers a destination call in which this exit floor determined by the exit floor determination part 22 is a destination floor. And the destination call registration part 21 determines an assigned car to this registered destination call. In succeeding Step S16, the group control device 20 sends a call assignment instruction including destination floor information to the car control part 31 of an each-car controller 30 corresponding to the assigned car.

At Step S17 the car control part 31 receives this call assignment instruction sent from the group control device 20. And the flow of actions proceeds to Step S18, where the car control part 31 carries out a call assignment action for the assigned car, i.e., an action of causing the assigned car to run to the destination floor, and finishes a processing routine of a series of actions.

The elevator system configured as described above is an elevator system having a destination call registration device which accepts an operation of registering a destination call by a user and an exit floor selection part which is provided in this destination call registration device and by use of which a user selects an exit floor as a destination floor of the destination call. This elevator system is provided with an exit floor determination part which determines, on the basis of predetermined conditions, which floor is the exit floor from candidates for an exit floor which are set beforehand and a destination call registration part which registers the destination call in which the specific floor determined as the exit floor by the exit floor determination part is a destination floor, in the case where the exit floor selection part was operated by a user.

For this reason, for a destination call in which a destination floor was specified by a user as an exit floor, it is possible to make the registration of the destination call and the car assignment to a registered call optimum, enabling operational efficiency to be made good.

Embodiment 2

Figure 4:
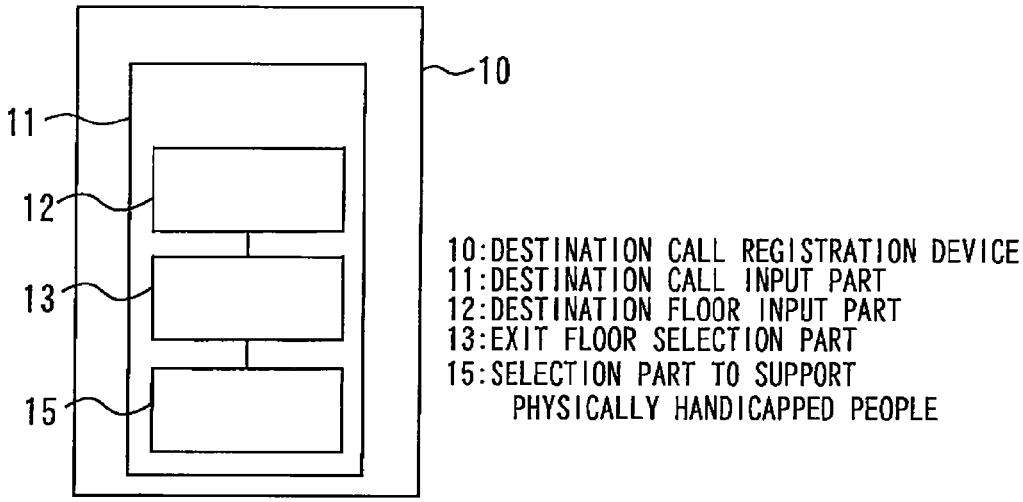
FIG. 4 is a block diagram showing the configuration of a destination call registration device of an elevator system relating to Embodiment 2 of the present invention.

FIG. 4 relates to Embodiment 2 of the present invention and is a block diagram showing the configuration of a destination call registration device.

Embodiment 2 described here is such that in the configuration of the above-described Embodiment 1, the destination call registration device is provided with a selection part to support physically handicapped people by use of which a physically handicapped person represented by, for example, a wheelchair user, registers a destination call in which an exit floor is a destination floor, whereby it is determined which floor is the exit floor depending on whether or not this selection part to support physically handicapped people was operated.

That is, as shown in FIG. 4, the destination call input part 11 of the destination call registration device 10 is provided with a selection part to support physically handicapped people 15 by use of which a physically handicapped person represented by, for example, a wheelchair user, selects an exit floor as a destination floor in addition to the destination floor input part 12 and the exit floor selection part 13. This selection part to support physically handicapped people 15 may be provided with an exit floor button to support physically handicapped people in the same manner as the exit floor selection part 13, for example, or this selection part to support physically handicapped people 15 may be such that separately from the destination call input part 11, a destination call input part for physically handicapped people is provided and the selection part to support physically handicapped people 15 is provided in the destination call input part for physically handicapped people.

When this selection part to support physically handicapped people 15 of the destination call registration device 10 has been operated, the destination call registration device 10 sends, to the group control device 20, a destination call registration request in which an exit floor to support physically handicapped people is a destination floor. And in the case where the destination floor of the destination call registration request sent from the destination call registration device 10 was an exit floor to support physically handicapped people, the exit floor determination part 22 of the group control device 20 determines which floor is the exit floor to support physically handicapped people which is the destination floor of this destination call registration request.

That is, predetermined conditions under which the exit floor determination part 22 determines an exit floor include the element that whether or not the destination floor of the destination call registration request is an exit floor to support physically handicapped people, that is, whether or not the selection part to support physically handicapped people 15 was operated. A description will be given of this determination of an exit floor based on predetermined conditions by the exit floor determination part 22 by taking concrete examples.

First, a description will be given of the case where an exit floor is determined on the basis of the congested condition of the elevator as a condition, which was described as a first example in Embodiment 1. In this case, when the destination floor of the destination call registration request was an exit floor to support physically handicapped people, an entrance floor where the entrance of the building exists (a standard floor) is regarded as an exit floor regardless of the congested condition of the elevator.

In this example, an entrance floor (a standard floor) and a floor one floor above this standard floor, i.e., two floors are set beforehand as candidates for an exit floor. And the exit floor determination part 22 determines the exit floor as a standard floor in the case where the congestion degree of the elevator is smaller than a predetermined threshold value or in the case where the selection part to support physically handicapped people 15 was operated, and the exit floor determination part 22 determines the exit floor as a floor one floor above the standard floor in the case where the selection part to support physically handicapped people 15 was not operated and the congestion degree of the elevator is larger than a predetermined threshold value.

In the first example described in Embodiment 1, when the elevator is crowded, as a rule a floor one floor above an entrance floor (a standard floor) becomes an exit floor, and therefore, a physically handicapped person, such as a wheelchair user, must move to an entrance floor by moving means other than an elevator in order to leave the building after disembarking from an elevator at the relevant exit floor. In contrast to this, in the case of this Embodiment 2, when the selection part to support physically handicapped people 15 was operated, it is possible to determine an entrance floor which is convenient for the movement of physically handicapped people as an exit floor regardless of the congested condition of the elevator.

In the case where there are a plurality of floors which are convenient for the movement of physically handicapped people, it is possible to adopt the following method; that is, these plurality of floors are beforehand included in candidates for an exit floor, and in the case where the selection part to support physically handicapped people 15 was operated, an exit floor is selected and determined from these floors which are convenient for the movement of physically handicapped people. Also, the same exit floor is not prevented from being determined as a consequence in the case where the selection part to support physically handicapped people 15 was operated and in the case where the exit floor selection part 13 was selected.

Next, a description will be given of the elevator system in which an exit floor is determined on the basis of conditions including, as elements, operation modes of a double-deck elevator and a departure floor of a destination call which is going to be registered from now in the case where the elevator described as the third example in Embodiment 1 is a double-deck elevator. In this case, whether the exit floor during a double operation becomes an exit floor for the upper car or an exit floor for the lower car is determined by a car assigned to a destination call registration, i.e., the departure floor of the destination call registration.

In general buildings, there is often a main entrance and either an exit floor for the upper car or an exit floor for the lower car is a floor where there is a main entrance. Therefore, depending on the departure floor, the exit floor may sometimes be an exit floor on the side where there is no main entrance. In this case, after disembarking from an elevator at the exit floor in question, a physically handicapped person, such as a wheelchair user, needs to move to another exit floor where there is a main entrance by moving means except an elevator.

Therefore, in this example, in the case where the selection part to support physically handicapped people 15 was operated, the exit floor determination part 22 determines, as an exit floor, the floor where there is a main entrance, which is either an exit floor for the upper car or an exit floor for the lower car, regardless of the departure floor during a double operation.

The circumstances of this third example apply also to the case where a semi-zone operation is carried out using the one-shaft multi-car elevator described as the fourth example in Embodiment 1. That is, a standard floor of each car during a semi-zone operation becomes a floor which can be determined as an exit floor, but there is a possibility that floors on which there is no main entrance are included in these standard floors of each car. For this reason, depending on the departure floor, the exit floor may sometimes be a floor where there is no main entrance, and after disembarking from an elevator at the exit floor in question, a physically handicapped person, such as a wheelchair user, needs to move to another floor where there is a main entrance by moving means except an elevator in order to leave the building.

Therefore, in this example, in the case where the selection part to support physically handicapped people 15 was operated, the exit floor determination part 22 determines, as an exit floor, the floor where there is a main entrance regardless of the departure floor during a semi-zone operation.

Other configurations and actions are the same as in Embodiment 1 and detailed descriptions thereof are omitted.

The elevator system configured as described above is such that in the configuration of Embodiment 1, an exit floor selection part to support physically handicapped people is provided by use of which a physically handicapped person selects an exit floor as a destination floor of a destination call, and predetermined conditions under which the exit floor determination part determines which floor is the exit floor include at least whether or not the exit floor selection part to support physically handicapped people was operated. For this reason, in addition to that the same effect as in Embodiment 1 can be obtained, when a physically handicapped person represented by a wheelchair user registered a call to an exit floor, it is possible to determine a floor which is convenient for the movement of the physically handicapped person as an exit floor.

Embodiment 3

Figure 5:
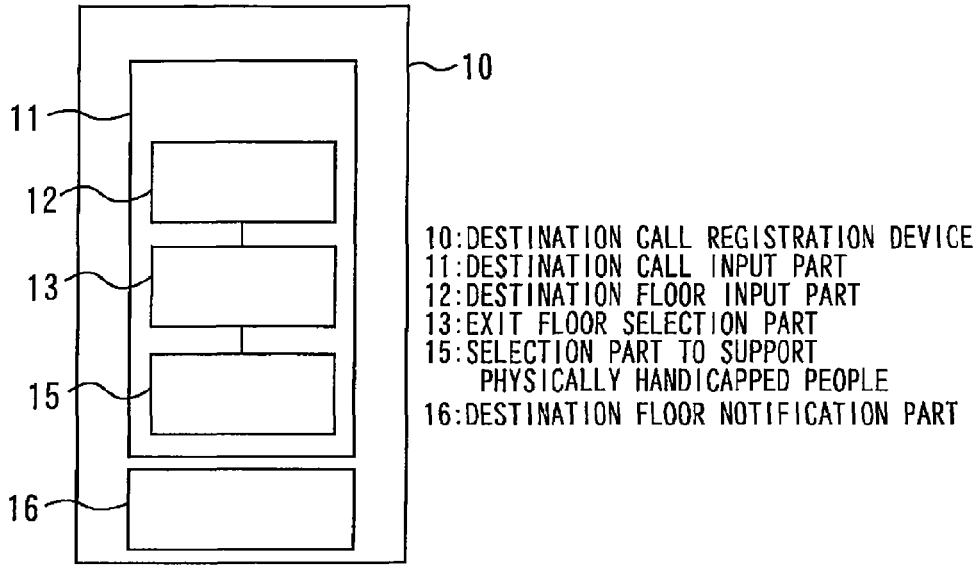
FIG. 5 is a block diagram showing the configuration of a destination call registration device of an elevator system relating to Embodiment 3 of the present invention.
Figure 6:
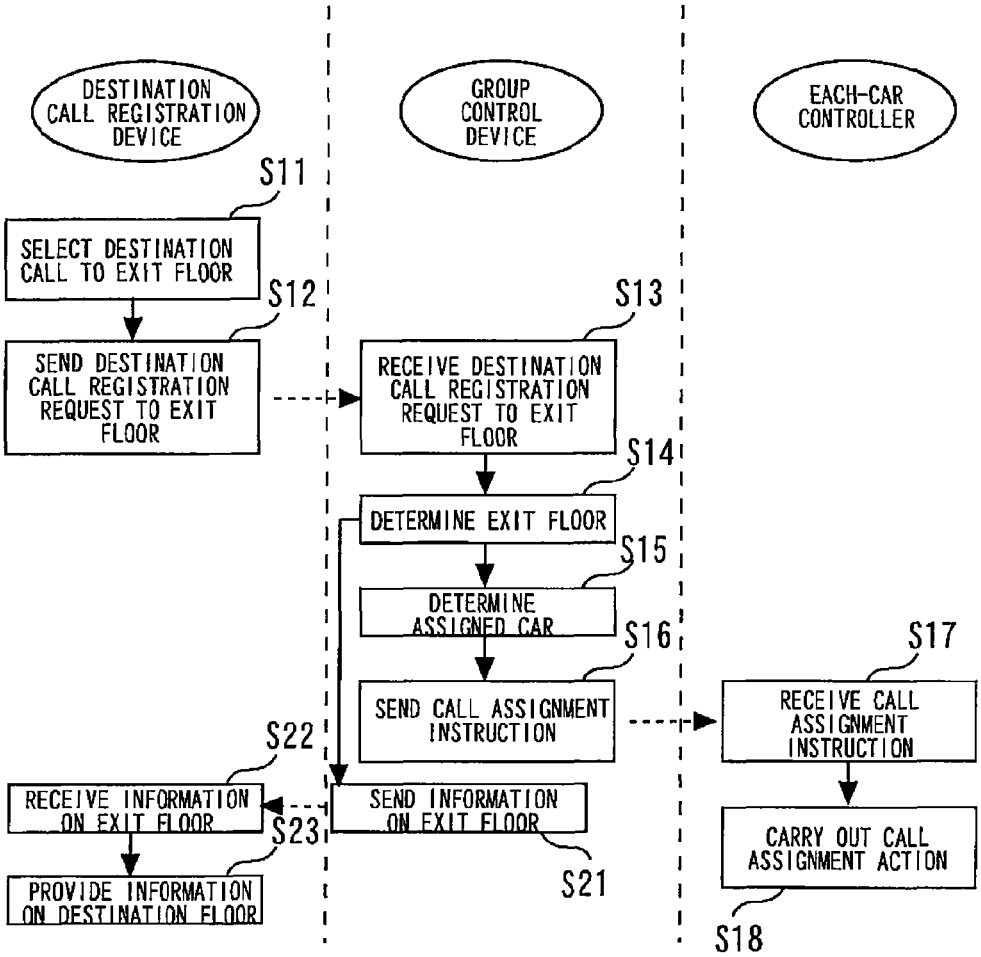
FIG. 6 is a flowchart showing registration actions of the elevator system for a destination call to an exit floor, the elevator system relating to Embodiment 3 of the present invention.

FIGS. 5 and 6 relate to Embodiment 3 of the present invention. FIG. 5 is a block diagram showing the configuration of a destination call registration device and FIG. 6 is a flowchart showing registration actions of a destination call to an exit floor.

Embodiment 3 described here is such that in the configurations of Embodiment 1 and Embodiment 2 described above, the destination call registration device is provided with a destination floor notification part which notifies a user of information on an exit floor determined by the exit floor determination part.

That is, as shown in FIG. 5, the destination call registration device 10 is provided with a destination floor notification part 16. In the case where the destination floor of a destination call registration request sent from the destination call registration device 10 was an exit floor, the group control device 20 sends the specific floor determined as the exit floor by the exit floor determination part 22 to the destination call registration device 10. The destination floor notification part 16 notifies a user of the specific floor determined as the exit floor sent from this group control device 20.

This destination floor notification part 16 is formed from an indication device which is made of, for example, a liquid crystal display, and a user may be visually notified by indicating the specific floor determined as the exit floor on this indication device. It is also possible to provide a lamp of LED and the like in a manner corresponding to each destination floor and to notify by causing a lamp corresponding to the specific floor determined as the exit floor to light up. Furthermore, it is also possible to provide a speaker as the destination floor notification part 16 and to aurally notify a user by speaking the specific floor determined as the exit floor by voice from this speaker. In the case where the destination floor notification part 16 was formed from an indication device, it is also possible to use an indication device common to the indication part 14 and the destination floor notification part 16.

The flowchart of FIG. 6 shows actions of the elevator system in this embodiment. In this FIG. 6, the steps indicated by the same numerals as in FIG. 3 of Embodiment 1 have the same contents as in FIG. 3 and, therefore, detailed descriptions thereof are omitted. Here, Steps S21 to S23 added from FIG. 3 will be mainly described.

When in Step S14 the exit floor determination part 22 of the group control device 20 has determined an exit floor which becomes the destination floor of the destination call registration request received based on predetermined conditions, the destination call registration which succeeds from Step S15 is performed (the details were given above). And in parallel with this destination call registration processing the flow of actions proceeds to Step S21, where the group control device 20 sends information on the specific floor determined as the exit floor in Step S14 by the exit floor determination part 22 to the destination call registration device 10.

In Step S22 the destination call registration device 10 receives this information on the specific floor determined as the exit floor sent from the group control device 20. And the flow of actions proceeds to Step S23, where the destination floor notification part 16 of the destination call registration device 10 notifies a user of the received information on the specific floor determined as the exit floor.

Other configurations and actions are the same as in Embodiments 1 and 2 and detailed descriptions thereof are omitted.

The elevator system configured as described above is such that in the configurations of Embodiments 1 and 2, there is provided a destination floor notification part which notifies a user of the specific floor determined as the exit floor by the exit floor determination part in the case where the exit floor selection part was operated by the user. For this reason, when a user performed a call registration operation to an exit floor, it is possible for the user to get to know a specific floor onto which the user actually disembarks from a car.

Embodiment 4

Figure 7:
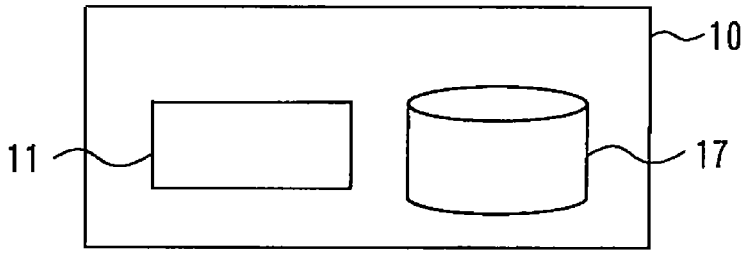
FIG. 7 is a block diagram showing the configuration of a destination call registration device of an elevator system relating to Embodiment 4 of the present invention.
Figure 8:
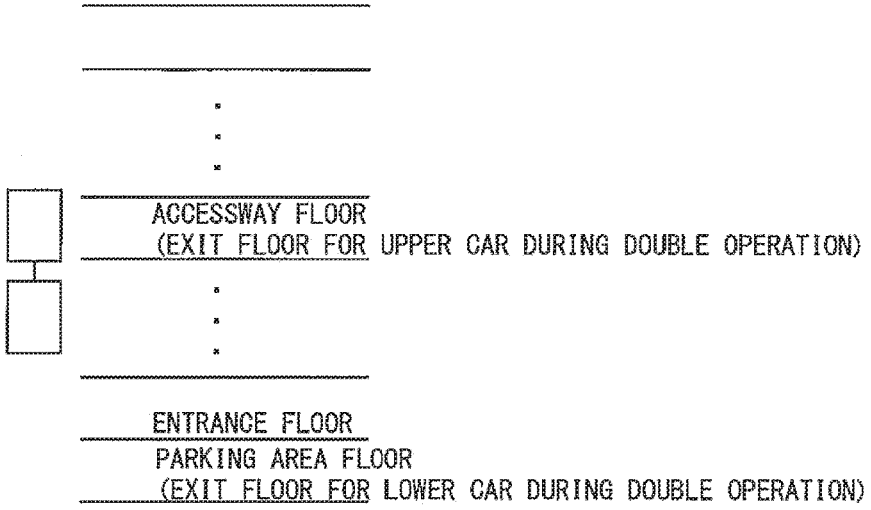
FIG. 8 shows a double-deck elevator according to one or more embodiments of the present invention.
Figure 9:
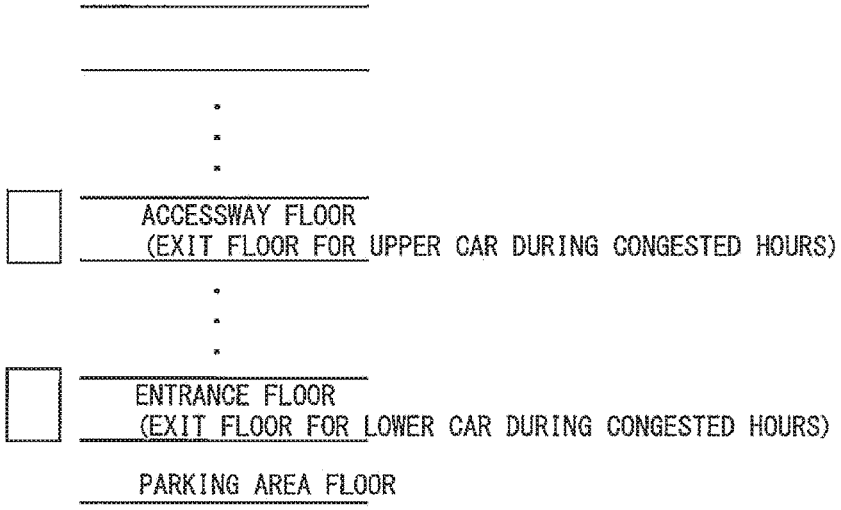
FIG. 9 shows a one shaft multi-deck elevator according to one or more embodiments of the invention.

FIG. 7 relates to Embodiment 4 of the present invention and is a block diagram showing the configuration of a destination call registration device.

In Embodiments 1 to 3 described above, each time a destination call registration request from the destination call registration device in which an exit floor is a destination floor is received, the exit floor determination part determines which floor is the exit floor. In contrast to this, Embodiment 4 which is described here determines which floor is the exit floor by constantly or periodically checking elements constituting predetermined conditions for determining an exit floor (the condition of the elevator, hours and the like). And the specific floor determined as the exit floor by the exit floor determination part is sent to the destination call registration device and is stored as exit floor data in the storage part of the destination call registration device.

That is, as shown in FIG. 7, the destination call registration device 10 stores exit floor data 17 in the storage part. The group control device 20 constantly or periodically checks elements constituting predetermined conditions for determining an exit floor (the conditions of the elevator, hours and the like) and the exit floor determination part 22 determines which floor is the exit floor on the basis of predetermined conditions each time the constituent elements of predetermined conditions change. And each time an exit floor is determined by the exit floor determination part 22, the group control device 20 sends information on this specific floor determined as the exit floor to the destination call registration device 10.

Each time the destination call registration device 10 receives information on the specific floor determined as the exit floor, the destination call registration device 10 updates the stored exit floor data 17 to up-to-date data. And in the case where the configuration of this Embodiment 4 was applied to the configuration of Embodiment 3, when the exit floor selection part 13 is operated, the destination floor notification part 16 reads the exit floor data 17 in the storage part and notifies a user of the specific floor determined as the exit floor.

Also, in the case where the configuration of this Embodiment 4 was applied to the configuration of Embodiment 2 having the selection part to support physically handicapped people 15, it may be ensured that the exit floor determination part 22 determines both exit floors in the case where the exit floor selection part 13 was operated and in the case where the selection part to support physically handicapped people 15 was operated, and sends the exit floors to the destination call registration device 10, and that the destination call registration device 10 stores both exit floors as exit floor data 17 in the case where the exit floor selection part 13 was operated and in the case where the selection part to support physically handicapped people 15 was operated.

And in this Embodiment 4, in the case where the exit floor selection part 13 (the selection part to support physically handicapped people 15) was operated by a user, it is also possible to obtain a specific floor which becomes an exit floor by referring to exit floor data 17 and to send a destination call registration request in which the obtained specific floor is a destination floor instead of sending a destination call registration request in which an exit floor is a destination floor. In this case, the destination floor of a destination call registration request which is sent becomes a specific floor both in the case where the exit floor input means 11 was operated and in the case where the exit floor selection part 13 (the selection part to support physically handicapped people 15) was operated.

Other configurations and actions are the same as in Embodiments 1 to 3 and detailed descriptions thereof are omitted.

The elevator system configured as described above is such that in the configurations of Embodiments 1 to 3, the destination call registration device stores, as exit floor data, the specific floor determined as the exit floor by the exit floor determination part. For this reason, in the case of a combination with, in particular, the destination floor notification part of Embodiment 3, when a user performs a registration operation of a call to an exit floor, the user can instantaneously get to know a specific floor onto which the user actually disembarks from a car.

Also, even when no destination floor notification part is provided, also in the case where the exit floor selection part was operated, it is possible to send from the destination call registration device a destination call registration request in which a specific destination floor is specified in the same manner as with the case where the destination floor input part was operated. Therefore, the processing in the destination call registration part on the receiving side can be made uniform.

INDUSTRIAL APPLICABILITY

The present invention can be applied to an elevator system which is such that a destination call registration device which accepts an operation of registering a destination call by specifying a destination floor of an elevator is provided with an exit floor selection part by use of which a user selects an exit floor as a destination floor of a destination call.

DESCRIPTION OF SYMBOLS

10 destination call registration device
11 destination call input part
12 destination floor input part
13 exit floor selection part
14 indication part
15 selection part to support physically handicapped people
16 destination floor notification part
17 exit floor data
20 group control device
21 destination call registration part
22 exit floor determination part
30 each-car controller
31 car control part

The invention claimed is:

1. An elevator system having a destination call registration device which accepts an operation of registering a destination call by specifying a destination floor of an elevator and an exit floor selection part which is provided in the destination call registration device and by use of which a user selects an exit floor provided with an exit of a building in which the elevator is installed as a destination floor of the destination call, the elevator system comprising:

an exit floor determination part which determines, on the basis of predetermined conditions, a specific floor as the exit floor from candidates for an exit floor which are set beforehand as floors capable of being selected as the exit floor provided with an exit of a building among a plurality of floors of the building; and a destination call registration part which registers the destination call in which the specific floor determined as the exit floor by the exit floor determination part is a destination floor, in the case where the exit floor selection part is operated by a user.

2. The elevator system according to claim 1, wherein at least a congested condition of the elevator is included in elements constituting the predetermined conditions.

3. The elevator system according to claim 1, wherein a present time of day is included in elements constituting the predetermined conditions.

4. The elevator system according to claim 2, wherein a present time of day is included in elements constituting the predetermined conditions.

5. The elevator system according to claim 1, wherein the elevator is a double-deck elevator which has two cars vertically adjacent to each other, and wherein at least an operation mode of the double-deck elevator and a departure floor of the destination call are included in elements constituting the predetermined conditions.

6. The elevator system according to claim 1, wherein the elevator is a one-shaft multi-deck elevator in which a plurality of cars are disposed in one shaft, and wherein at least an operation mode of the one-shaft multi-deck elevator and a departure floor of the destination call are included in elements constituting the predetermined conditions.

7. The elevator system according to claim 1, further comprising:

an exit floor selection part configured to be used by physically handicapped people which is provided in the destination call registration device and by use of which a physically handicapped person selects the exit floor as a destination floor of the destination call, and wherein at least whether or not the exit floor selection part for physically handicapped people has been operated is included in the predetermined conditions.

8. The elevator system according to claim 5, further comprising:

an exit floor selection part configured to be used by physically handicapped people which is provided in the destination call registration device and by use of which a physically handicapped person selects the exit floor as a destination floor of the destination call, and wherein at least whether or not the exit floor selection part for physically handicapped people has been operated is included in the predetermined conditions.

9. The elevator system according to claim 6, further comprising:

an exit floor selection part configured to be used by physically handicapped people which is provided in the destination call registration device and by use of which a physically handicapped person selects the exit floor as a destination floor of the destination call, and wherein at least whether or not the exit floor selection part for physically handicapped people has been operated is included in the predetermined conditions.

10. The elevator system according to claim 1, further comprising:

a destination floor notification part which, in the case where the exit floor selection part is operated by a user, notifies the user of the specific floor determined as the exit floor by the exit floor determination part.

11. The elevator system according to claim 5, further comprising:

a destination floor notification part which, in the case where the exit floor selection part is operated by a user, notifies the user of the specific floor determined as the exit floor by the exit floor determination part.

12. Presented : The elevator system according to claim 6, further comprising:

a destination floor notification part which, in the case where the exit floor selection part is operated by a user, notifies the user of the specific floor determined as the exit floor by the exit floor determination part.

13. The elevator system according to claim 1, wherein the destination call registration device stores the specific floor determined as the exit floor by the exit floor determination part as exit floor data.

14. The elevator system according to claim 5, wherein the destination call registration device stores the specific floor determined as the exit floor by the exit floor determination part as exit floor data.

15. The elevator system according to claim 6, wherein the destination call registration device stores the specific floor determined as the exit floor by the exit floor determination part as exit floor data.

* * * * *